United States Patent [19]

Köbler et al.

[11] 4,357,871

[45] Nov. 9, 1982

[54] SEPARABLE INK SUPPLY TROUGH FOR ROTARY PRINTING PRESS

[75] Inventors: Ingo Köbler, Gessertshausen; Rainer Burger, Augsburg, both of Fed. Rep. of Germany

[73] Assignee: M.A.N.-Roland Druckmaschinen Aktiengesellschaft, Offenbach am Main, Fed. Rep. of Germany

[21] Appl. No.: 165,095

[22] Filed: Jul. 1, 1980

[30] Foreign Application Priority Data

Jul. 24, 1979 [DE] Fed. Rep. of Germany ..... 2929891

[51] Int. Cl.[3] ..... B41F 31/02

[52] U.S. Cl. ..... 101/350; 101/364

[58] Field of Search ..... 101/364, 365, 350, 366, 101/367, 351, 207, 208, 209, 210, 363

[56] References Cited

U.S. PATENT DOCUMENTS

| | | | |
|---|---|---|---|
| 512,562 | 1/1894 | Moore | 101/210 |
| 987,814 | 3/1911 | Newton | 101/350 X |
| 1,112,412 | 7/1914 | Adam | 101/365 |
| 1,444,053 | 9/1916 | Beebe | 101/350 |
| 1,736,944 | 11/1929 | Schroeder | 101/364 |
| 1,883,572 | 10/1932 | Clark | 101/350 |
| 2,514,653 | 7/1950 | Lerch | 101/364 X |
| 3,013,489 | 12/1961 | Moser et al. | 101/350 |
| 3,097,597 | 7/1963 | Visser | 101/364 |
| 3,828,665 | 9/1974 | Ogura et al. | 101/350 |
| 4,084,510 | 4/1978 | Schweitzer et al. | 101/365 |
| 4,092,922 | 6/1978 | Schweitzer | 101/363 |

FOREIGN PATENT DOCUMENTS

| | | | |
|---|---|---|---|
| 860042 | 12/1952 | Fed. Rep. of Germany | 101/179 |
| 2230126 | 1/1974 | Fed. Rep. of Germany . | |
| 2629331 | 1/1978 | Fed. Rep. of Germany . | |
| 609280 | 2/1979 | France | 101/364 |
| 1123639 | 9/1968 | United Kingdom | 101/350 |

*Primary Examiner*—Edgar S. Burr
*Assistant Examiner*—Charles Pearson
*Attorney, Agent, or Firm*—Frishauf, Holtz, Goodman & Woodward

[57] ABSTRACT

To permit removal of an ink trough holding ink from an inking structure, the structure is formed with separable upper (2) and lower (3) portions, the upper portion being formed with an outlet (4) which, in cross section, is essentially funnel-shaped; a closure element (9), for example in form of a ball or a cylinder (4') fitting into the funnel-shaped opening (4) is positioned in the upper portion which has a lower inclined surface (13) leading, essentially tangentially, towards an ink transfer or ductor roller (6). A doctor blade (5) is positioned between the upper and lower portions adjacent the outlet (4) from the trough so that, upon moving the closure element (4') into the funnel-shaped opening, and separating the portions, for example by loosening of a bolt (7), the upper portion can be removed for cleaning or exchange of ink without disturbing the doctor blade and its adjustment.

9 Claims, 1 Drawing Figure

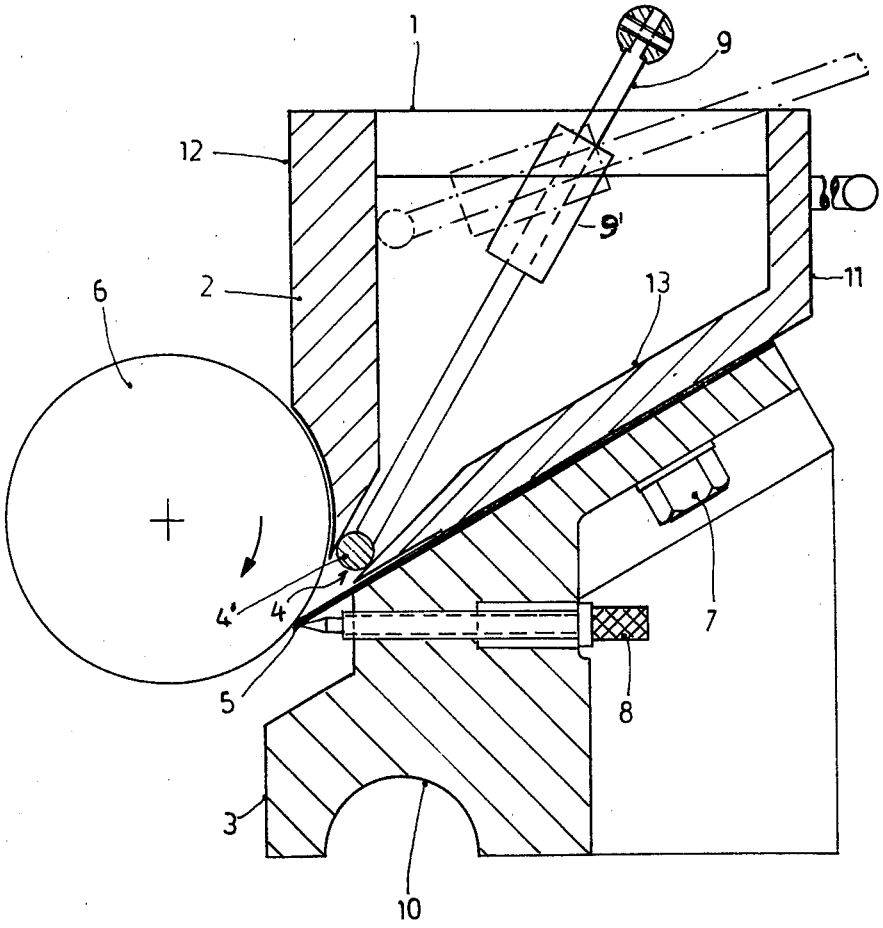
1
9
12
9'
6
2
13
11
4'
4
7
5
8
3
10

SEPARABLE INK SUPPLY TROUGH FOR ROTARY PRINTING PRESS

The present invention relates to an ink trough for a rotary printing machine, and more particularly to an ink trough which is made separable so that it can readily be removed from the printing machine, for cleaning or for exchange of ink of different composition or color for example, and which has a doctor blade engageable with a ductor roller, forming an ink transfer roller and applying ink from the trough to the inking system of the machine.

BACKGROUND AND PRIOR ART

Changing ink, in order to change color, ink composition or the like, in ink troughs of various types of printing machines is usually quite time-consuming. The ink troughs must be cleaned meticulously either while installed in the machine, or the ink troughs have to be disassembled, together with the applicable doctor blade and its adjustment mechanism from the machine. Otherwise, tipping the ink trough for emptying the same is also difficult since it is not easy to avoid spillage of ink and hence soiling the machine. Ink troughs or fountain systems having a portion which can be tipped are described, for example, in German Published Patent Applications DE-AS No. 22 30 126 and DE-AS No. 26 29 331.

THE INVENTION

It is an object to improve the construction of ink troughs in printing machines such that the trough portion can be readily removed from the machine without danger of spillage or dripping of ink, and not requiring removal of the doctor blade and associated mechanism.

Briefly, in accordance with the invention, the ink trough has an upper portion shaped to define an ink holding vessel, and formed with an outlet leading towards the transfer or ductor roller. A closure element is provided, selectively movable between a blocking or unblocking position of the opening. The upper portion is removably attached to the lower portion, for example by bolts or the like. The doctor blade is attached to one of the portions, preferably the lower portion, so that it can remain on the machine, and the adjustment thereof is not disturbed upon replacement of the upper portion of the ink supply structure.

The trough portion, that is, the portion of the structure which forms the actual ink trough, can be made so light that it can be easily removed, merely by removing the holding elements, typically bolts, for replacement of only that portion, for example by another one which carried a different type or color of ink. In accordance with a feature of the invention, the closure element is a movable cylinder, fitting into the outlet opening which is formed as an elongated tapered or funnel-shaped outlet extending in the direction of the doctor blade, that is, essentially tangentially towards the ductor or ink transfer roller. This arrangement permits inking of the ductor roller at clearly defined regions with a controllable quantity of ink so that, by properly adjusting the doctor blade, the quantity of ink being supplied can be accurately determined.

Drawing, illustrating a preferred embodiment:

The single FIGURE is a highly schematic transverse sectional view illustrating the ink trough structure, and its association with an ink transfer roller or ductor roller, and omitting all elements not necessary for an understanding of the invention.

The ink trough structure 1 has an upper portion 2 and a lower portion 3. The upper portion 2, forming the actual ink trough, has an outlet 4 which , in cross section, is funnel-shaped, that is, has inclined walls leading to the actual outlet opening itself. A closure element 9 is movable within the interior of the upper portion 2. The upper portion 2 has an essentially vertically extending long leg 12 and a short leg 11. The two legs are connected by an inclined bottom wall 13 leaving, however, opening 4 free. The funnel-shaped opening 4 leads approximately tangentially to an ink transfer roller or ink ductor roller 6. The closure element 9 preferably is an elongated rod held in a suitable slide holder 9', and terminating at its lower end in a ball or cylinder, respectively, to close off opening 4, the shape of the element 4' depending on the shape of the outlet 4.

The lower portion 3 can be tipped or tilted about a circular shaft (not shown) which is fitted into the semicircular opening 10. A doctor blade 5 is secured to the lower portion to engage the ductor roller 6 approximately tangentially. One or more adjustment screws 8 are provided, extending through the lower portion 3 to adjust the engagement of the doctor blade 5 with the ductor roller 6. One or more bolts 7, preferably passing through suitable openings in the doctor blade as well secure the upper portion 2 to the lower portion 3.

The upper portion 2 preferably is portable. Upon loosening nut or bolt 7, the upper portion 2 can be exchanged for other similar portions, for example to permit cleaning of the removed portion, to change to different colors ink, or the like. Removing the upper portion also exposes the doctor blade 5.

A plurality of individually exchangeable ink trough portions 2 are located along the ductor roller 6. The number and size of the respective troughs 2 depends on the weight which still can be readily handled by personnel working with the printing machine.

Various changes and modifications may be made within the scope of the inventive concept.

We claim:

1. Separable ink supply trough structure for a rotary printing machine having a lower support portion (3) having an upper inclined support surface;

an ink transfer roller (6);

a doctor blade (5) located on the inclined support surface to adjust the amount of ink being supplied to the transfer roller;

means (8) for controlling the position of the doctor blade with respect to the transfer roller (6) secured to the lower portion;

an upper portion (2) including a bottom wall and two wall leg portions (11,12) shaped to define an ink trough having an inclined bottom wall (13), said ink trough being formed with an outlet (4) formed by non-parallel surfaces which are fixed with respect to each other at the lowest corner of said upper portion, said surfaces being the end faces of the bottom wall and one leg portion (12) of said upper portion which is adjacent said corner, said outlet tapering towards a narrow mouth and, in cross section, being essentially funnel-shaped, said outlet being directed towards and positioned adjacent the transfer roller at the lowermost edge of the bottom wall and located above the doctor blade;

the upper portion (2) being removably secured to the lower portion;

the doctor blade being positioned between said upper and lower portions, carried by one of said portions and extending at least in part across said outlet to direct the flow of ink from the outlet to the transfer roller and control the quantity of ink being applied on the roller;

and a closure element (9) located within said ink trough selectively movable between said non-parallel surfaces of said outlet between blocking and unblocking positions of said outlet, to permit closing of the opening in the ink trough and removal thereof independently of the positions of the doctor blade.

2. Structure according to claim 1, wherein the upper portion (2) is, in cross section, essentially U-shaped and includes said leg portions (11,12), which are of different lengths, said bottom wall (13) extending at an inclination approximately tangentially towards the ink transfer roller (6), the outlet (4) being positioned between the longer one of said leg portions (12) and the inclined bottom portion leading towards the ductor roller (6).

3. Structure according to claim 2, further including separable attachment means (7) securing the upper portion to the lower portion in the region of the inclined bottom wall (13).

the doctor blade being positioned adjacent the inclined bottom wall (13) and between said upper and lower portions.

4. Structure according to claim 1 wherein the doctor blade (5) is secured to the lower portion (3) to permit removal of the upper portion without disturbing the doctor blade.

5. Structure according to claim 1 wherein the closure element, in cross section, is essentially circular.

6. Structure according to claim 5 wherein the closure element further includes an operating handle attached to said element of essentially circular cross section (4') extending outside of said upper portion (2).

7. Structure according to claim 1 wherein the upper portion (2) is, in cross section, essentially U-shaped, said bottom wall (13) extending at an inclination approximately tangentially towards the ink transfer roller, the outlet being positioned adjacent the lower end of the inclined bottom wall.

8. Structure according to claim 7, further including separable attachment means (7) securing the upper portion to the lower portion in the region of the inclined bottom wall (13) of the upper portion, the doctor blade being positioned adjacent the inclined bottom wall (13).

9. Structure according to claim 7, wherein the closure element, in cross section, is essentially circular.

* * * * *